US009902036B1

(12) United States Patent
Ashley et al.

(10) Patent No.: US 9,902,036 B1
(45) Date of Patent: Feb. 27, 2018

(54) APPARATUS AND METHOD FOR RESHAPING BANDSAW WHEEL

(71) Applicants: Lester Ashley, Elora, TN (US); Ambers F. Williams, Fayetteville, TN (US)

(72) Inventors: Lester Ashley, Elora, TN (US); Ambers F. Williams, Fayetteville, TN (US)

(73) Assignee: TRUE WHEEL, INC., Elora, TN (US)

( * ) Notice: Subject to any disclaimer, the term of this patent is extended or adjusted under 35 U.S.C. 154(b) by 680 days.

(21) Appl. No.: 13/965,967

(22) Filed: Aug. 13, 2013

Related U.S. Application Data

(60) Provisional application No. 61/682,555, filed on Aug. 13, 2012.

(51) Int. Cl.
*B24B 23/08* (2006.01)
*B24B 19/00* (2006.01)

(52) U.S. Cl.
CPC ..... *B24B 23/08* (2013.01); *B24B 19/009* (2013.01)

(58) Field of Classification Search
CPC ..... B24B 23/08; B24B 19/009; B24B 5/36; B24B 5/363
USPC ..... 451/49
See application file for complete search history.

(56) References Cited

U.S. PATENT DOCUMENTS 2,627,708 A * 2/1953 Mater ..... B24B 5/36 451/425
3,305,979 A * 2/1967 Scherer ..... B24B 23/08 451/415
3,501,872 A * 3/1970 Mighton ..... B23B 5/168 266/56
3,641,716 A * 2/1972 Price ..... B24B 23/08 451/415
3,747,278 A * 7/1973 Woida ..... B24B 23/08 451/137
3,758,994 A * 9/1973 Dillinger ..... B23B 3/24 451/439
3,889,424 A * 6/1975 Buhayar ..... B24B 5/363 451/142
4,841,675 A * 6/1989 Perneczky ..... B24B 5/37 451/173
5,383,306 A * 1/1995 Michalon ..... B21B 28/04 451/106
5,819,613 A 10/1998 Wilson et al.
6,722,248 B1 4/2004 Johnston, Sr.
7,628,677 B1 * 12/2009 Branton ..... B24B 9/002 125/19

(Continued)

OTHER PUBLICATIONS

"Armstrong No. 51 Barnhart Band Wheel Grinder Operating Instructions," http://www.armstrongblue.com/Band_Saw/BarnhartOperDataSheet.htm, Aug. 1, 2012.

*Primary Examiner* — Larry E Waggle, Jr.
*Assistant Examiner* — Henry Hong
(74) *Attorney, Agent, or Firm* — Maynard Cooper & Gale, P.C.

(57) ABSTRACT

A reshaping apparatus for restoring the shape of the outer edge of a bandsaw wheel of a bandsaw is described. The reshaping apparatus is attached to frame member of the bandsaw and then adjust so that a die grinder with a grind rock is aligned for the reshaping process. The reshaping of the outer edge of the bandsaw wheel occurs without removing the bandsaw wheel from the bandsaw.

11 Claims, 8 Drawing Sheets

(56) References Cited

U.S. PATENT DOCUMENTS

2006/0128274 A1* 6/2006 Nyffenegger ..... B24B 19/11
451/11

* cited by examiner

APPARATUS AND METHOD FOR RESHAPING BANDSAW WHEEL

CROSS REFERENCE TO RELATED APPLICATION

This application claims priority to U.S. Patent Application No. 61/682,555 entitled "Apparatus and Method for Reshaping Bandsaw Wheel" and filed on Aug. 13, 2012, which is incorporated herein by reference.

BACKGROUND

At a sawmill operation, logs are often cut by a bandsaw designed for cutting logs of various diameters and lengths. The bandsaw blade of the bandsaw is a flat metal loop having teeth on one edge and no teeth on the other edge. The bandsaw blade is looped around two bandsaw wheels that put tension on the blade and pull the blade in such a direction that the teeth of the blade cut through the log as a bandsaw carriage moves along rails. The bandsaw wheels are rotated by a motor such as combustion engine or an electrical motor. The outer edge, i.e., the rim of each bandsaw wheel has crown shape in order to keep the blade near the center of the rim and positioned to provide an efficient cutting operation.

Over a period of time the crown shape of the rim of the wheel becomes somewhat flattened due to normal wear. In order to recondition, i.e., return the crown to a desired shape, the band saw wheel is removed and replaced with a new or refurbished band saw wheel having the desired crown shape on the rim of the bandsaw wheel. Such an operation may take several hours and places the saw in a nonproductive condition. Further, the bandsaw wheel that had a flattened rim is often shipped to a machine shop for reconditioning.

Because there is a variety of arrangements of bandsaw wheels and sizes of wheels, it is often necessary to have several replacement wheels stored near the sawmill operation using the bandsaw. If a replacement wheel is not available, then the bandsaw remains nonproductive until a replacement bandsaw wheel is located and installed. Bandsaw wheels are positioned along a vertical axis when a blade makes a vertical cut and are positioned along a horizontal axis when a blade makes a horizontal cut. In any arrangement of bandsaw wheels, if one wheel is worn, it may be necessary to remove and recondition additional band saw wheels. Hence, it is often desirable to keep a large inventory of bandsaw wheels to minimize downtime.

DESCRIPTION OF THE DRAWING

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views

DETAILED DESCRIPTION

The present disclosure describes a reshaping apparatus that reshapes or restores an edge of a rim of a bandsaw wheel from an undesirable shape, such as a flattened shape or other shape, to a desirable shape, such as a crown shape. Because of normal wear or failure of other bandsaw components the edge of the rim of a bandsaw wheel often becomes flattened or damaged. In order for a bandsaw to operate acceptably and efficiently a bandsaw wheel of the bandsaw must have its outer edge reshaped in accordance with a manufacturer's specification or a user's desired shape. In general, the desired shape is a crown shape wherein the peak of the crown is approximately at the center of the outer edge of the bandsaw wheel and the sides of the crown are approximately ten thousands of an inch lower than the peak of the crown. The height of the crown may vary as the width of the outer edge becomes larger or for other reasons.

Figure 1:
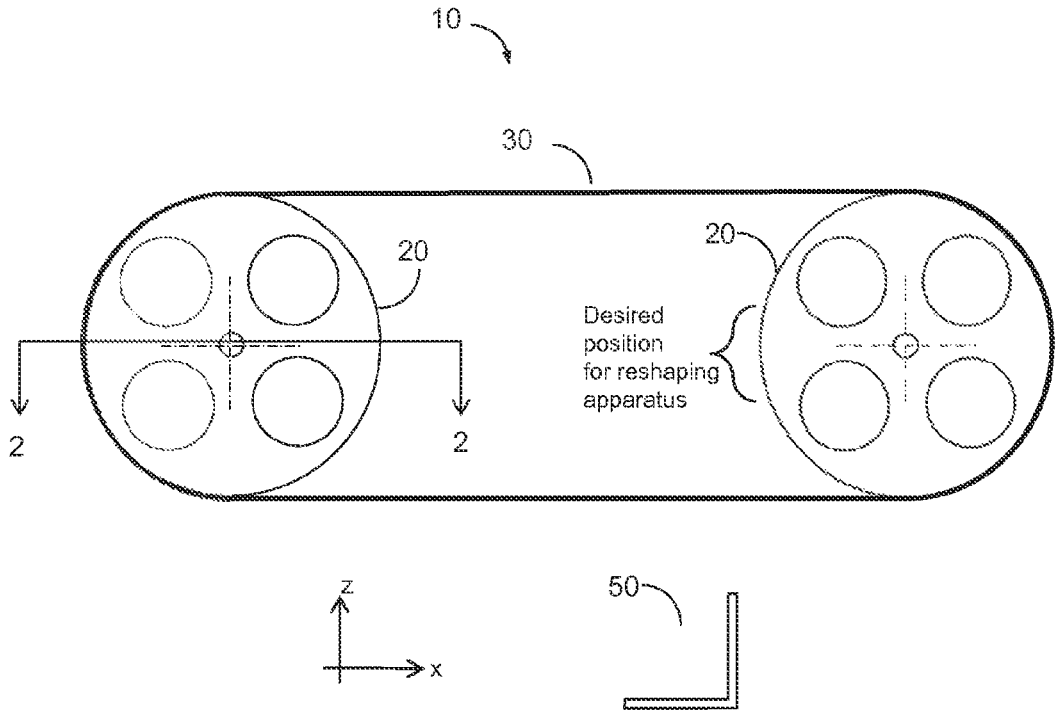
FIG. 1 depicts bandsaw wheels with a bandsaw blade looped around the wheels.
Figure 2:
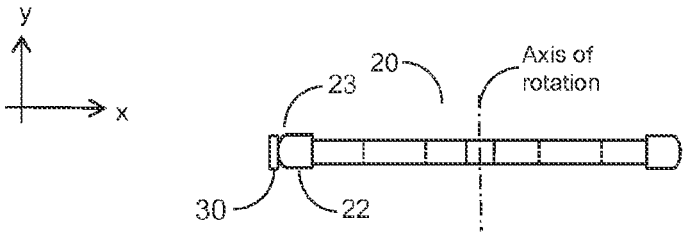
FIG. 2 depicts a section view of the bandsaw wheel of FIG. 1.

FIG. 1 depicts a bandsaw 10, with all the components of the bandsaw removed expect for two bandsaw wheels 20, a bandsaw blade 30, and a frame member 50 of the bandsaw. The bandsaw wheels 20 as depicted are round and have a center, an axis of rotation, about which they turn. The bandsaw blade 30 is a metal band that has a flat edge and a cutting edge that is held on the bandsaw wheels 20 by tension and blade guides. If the tension is too great the bandsaw wheels may wear unevenly or have the rim's outside edge wear at an undesirable rate. Too much tension could also damage the bandsaw blade or other components of the bandsaw 10. In addition, too much tension could cause blade failure. However, if the tension is not great enough the blade may not cut lumber or other material in an acceptable manor. A section view of bandsaw wheel 20 is depicted in FIG. 2. The outside edge 23 of the bandsaw wheel 20 is a part of a rim 22 that is furthest from the center of the bandsaw wheel. FIG. 2 shows the outside edge 23 of the bandsaw wheel 20 having a crown shape.

Figure 3:
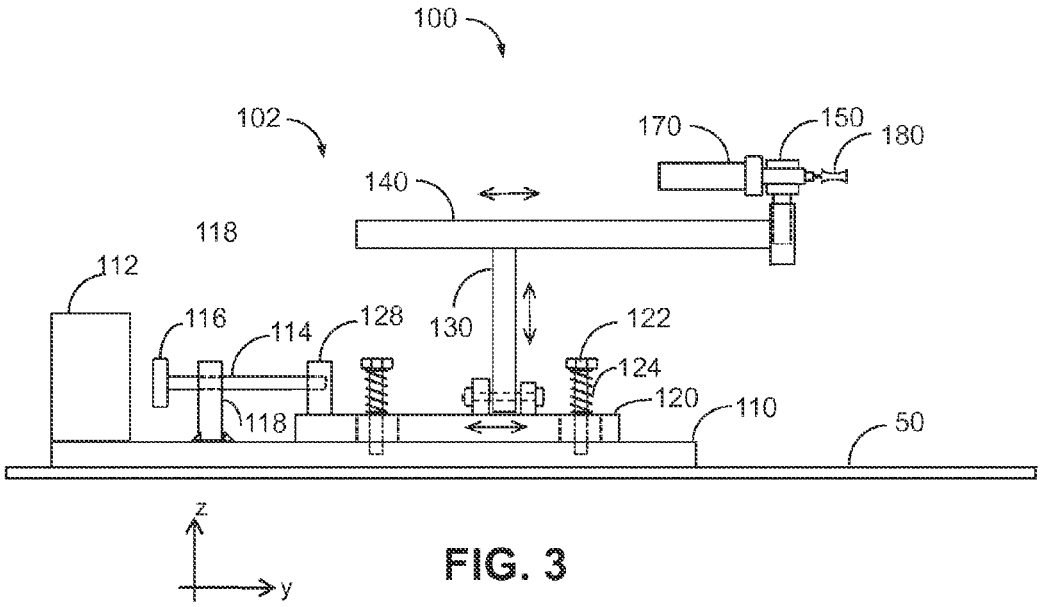
FIG. 3 depicts an embodiment of a reshaping apparatus of the present disclosure.

The reshaping apparatus of the present disclosure provides a bandsaw user a technique to reshape the outside edge of bandsaw wheel without removing the bandsaw wheel from the bandsaw. The reshaping apparatus comprises a positioning frame and a die grinder with a grind rock. The positioning frame comprising a vertical arm, a horizontal arm, and a clamp for holding the die grinder. The vertical arm extends from a base plate that is securely attached to a frame member of the bandsaw 10. The vertical arm may be extended to a desired length and then locked to that desired length. The horizontal arm is also extendable and lockable, and in addition the horizontal arm may rotate about the vertical arm. The clamp of the positioning frame that holds the die grinder is rotatable and capable of holding a die grinder from various manufacturers. When the grind rock is in a desired position for reshaping the bandsaw wheel, the die grinder and band saw are turned on. As the bandsaw wheel rotates the rotating grind rock is nudged towards the wheel and removes wheel material so that the outside edge of the bandsaw wheel is reshaped to a desired crown shape. A bandsaw wheel may rotate at several hundred revolutions per minute (rpm) and the die grinder may be turning the grid rock a rotational speeds of approximately 17,000 rpm FIG. 3 depicts an embodiment of a reshaping apparatus 100 in accordance with the present disclosure. The reshaping apparatus 100 comprises positioning frame 102, a die grinder 170 and a grind rock 180. The positioning frame 102 comprises a base plate 110 that rests on a frame member 50 of the bandsaw. The base plate 110 is securely and reversible attached to the frame member 50 using conventional connection techniques. The base plate as shown has an attachment flange 112 that extends upward (z-direction) from the base plate. In an embodiment for attaching the base plate to the frame member, a conventional C-clamp (not shown) holds the attachment flange 112 against a vertical flange of a bandsaw frame member. A bottom surface of the base plate rests on another portion of the bandsaw frame member. The other components of the positioning frame, as will be seen, are coupled to a top surface of the base plate 110.

A slide plate 120 of the positioning frame 102 is coupled to the base plate 110 by bolts 122 and springs 124 that fit through slots 126 in the slide plate. When positioning knob 116 is rotated in one direction the slide plate moves in the y-direction and when the positioning knob 116 is rotated in the other direction the slide plate moves in the negative y-direction. The positioning knob 116 is attached to a first end of threaded rod 114. Threaded rod 114 extends through a threaded hole in support block 118. The other end of the treaded rod 114 is rotationally anchored to a support bar 128 that extends upward (y-direction) from the slide plate 110. As the positioning knob 116 rotates the threaded rod 114 in one rotational direction the slide plate 120 moves in a first direction and moves in a second direction when the threaded rod rotates in a second direction. Because of the mechanical advantage provided by threaded rod, a complete turn of the threaded rod 114 moves the slide bar around a tenth of an inch or so. The slide plate 120 serves as a fine movement positioning component of the positioning frame 102 as would be understood by those skilled in the art.

FIG. 3 further depicts a vertical arm 130 for vertical (z-direction) positioning of the die grinder. The vertical arm 130 may be lengthened or shorted to provide a desired height with respect to the bandsaw wheel 20 to be reshaped. A horizontal arm 140 of the positioning frame 102 is attached perpendicularly to the vertical arm 130. The horizontal arm 140 may be lengthen or shortened to provide a desired horizontal location of the die grinder 170 with respect to the bandsaw wheel to be reshaped. A clamp 150 holding the die grinder 170 may be lowered, raised or rotated in order to align the center of the grind rock 180 with the center of the outer edge of the bandsaw wheel 20.

Figure 4:
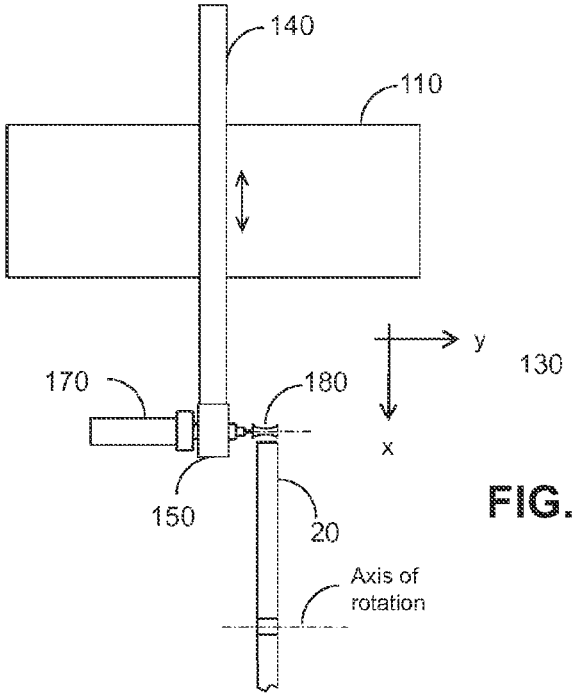
FIG. 4 depicts a top view of the reshaping apparatus of FIG. 3.

Once the grind rock 180 has a desired alignment position, as shown in FIG. 4, the grind rock 180 is poised to begin reshaping the bandsaw wheel. After the die grinder 170 is turned on and rotates, and the bandsaw is turned on and the bandsaw wheel rotates. As the grind rock 180 rotates an operator is pushes the grind rock towards the bandsaw wheel 20. As the rotating grid rock 180 engages the rotating bandsaw wheel, the grind rock 180 selectively removes material from the outer edge of the bandsaw wheel. The removed material results in a reshaping of the edge of the bandsaw wheel 20 in such a way that a desired shape of the edge of the bandsaw wheel is restored.

Figure 5:
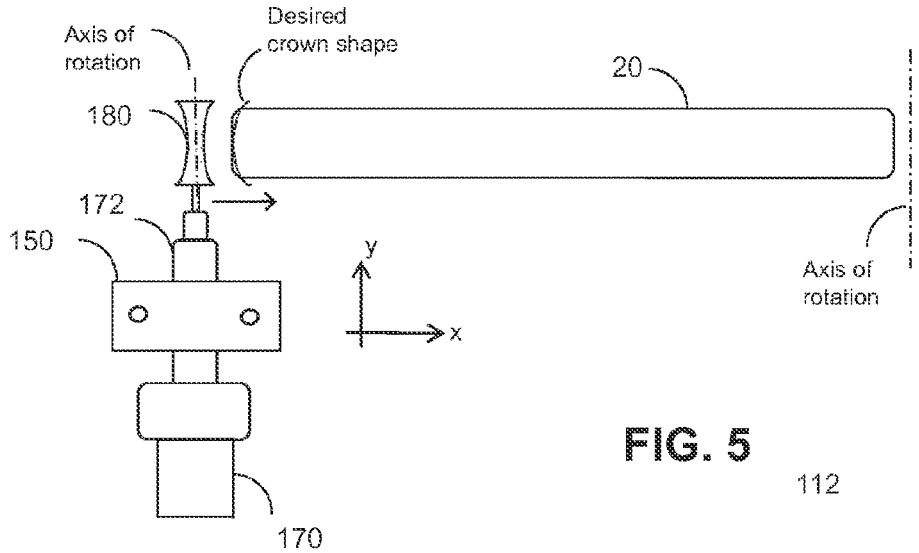
FIG. 5 depicts the reshaping apparatus FIG. 3 in a position to reshape a bandsaw wheel.

FIG. 5 depicts a desired alignment of the grind rock 180 with the bandsaw wheel 20. A desired alignment occurs when the axis or rotation of the grind rock is parallel with the axis of rotation of the bandsaw wheel 20. The dotted line, having a convex curve with respect to the bandsaw wheel, shows a desired crown shape. The grind rock 180 has a convex shape in order to provide the desired crown shape on the outer edge of the bandsaw wheel 20. Once the desired alignment is provided by movement components of the positioning frame 102, the position frame via an operator pushes the rotating grind rock towards the rotating bandsaw wheel. When the operator determines the bandsaw wheel 20 has the desired shape on its outer edge, the operator pulls the grind rock away from the bandsaw wheel.

Figure 6:
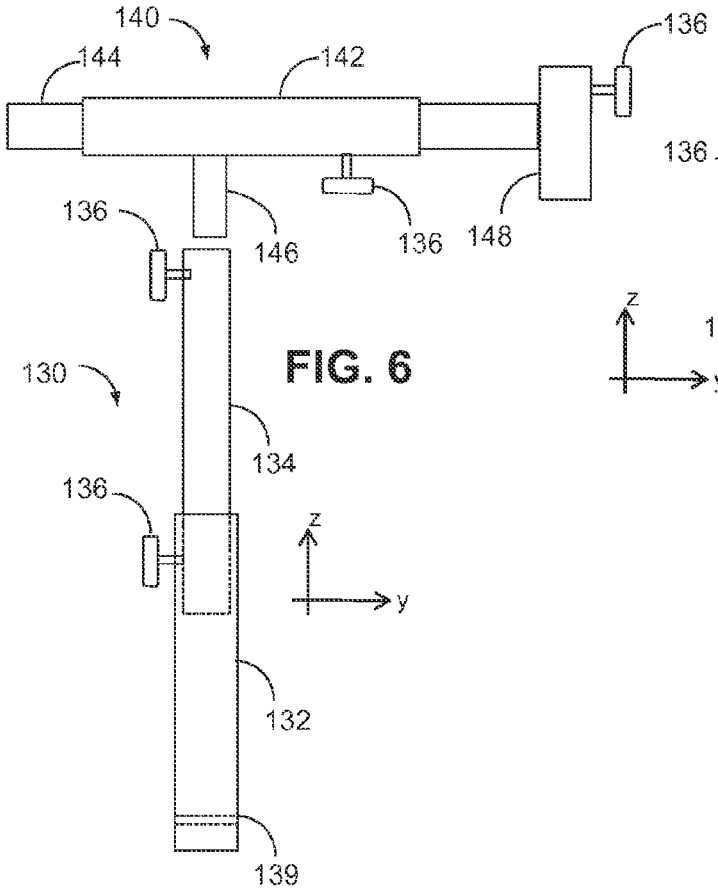
FIG. 6 depicts details of components of the reshaping apparatus of FIG. 3.
Figure 7:
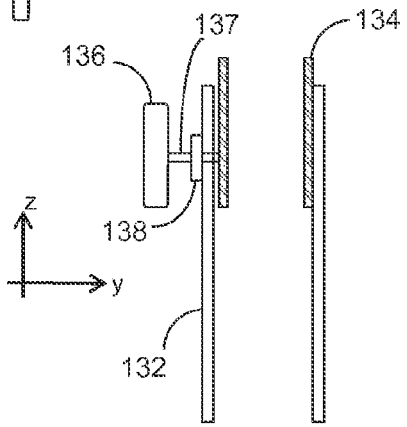
FIG. 7 depicts a position locking mechanism for the components of FIG. 6.

Details of an embodiment of the vertical arm 130 and the horizontal arm 140 are depicted in FIG. 6. The vertical arm 130 has an outer tube 132 and an inner tube 134. In order to provide the vertical arm 130 with a desired length, an operator places the lock knob in a unlock state. The inner tube 134 moves within the outer tube 132 when pushed or pulled by the operator. When the operator determines a desired length has been achieved, operator tightens the lock knob to a lock state to keep the vertical arm at its desired length. The operator moves the horizontal arm 140 to a desired length using a similar procedure. In addition the horizontal arm 140 is configured to rotate (0 to 360 degrees) via a rotation bar inserted in the inner vertical tube 134 of the vertical tube 130. The horizontal arm 140 has a clamp sleeve 148 for receiving a rotation bar 146 of the clamp 150.

Figure 8:
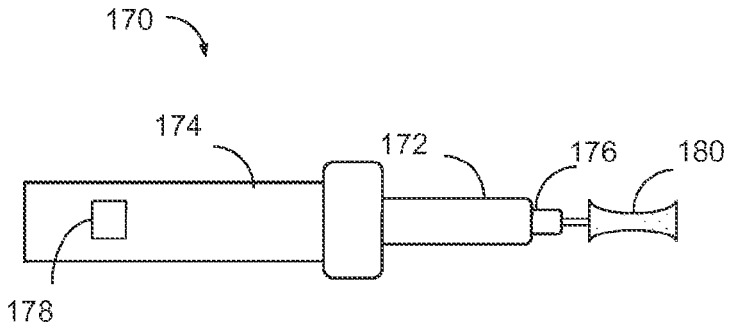
FIG. 8. depicts a conventional die grinder having a grind rock of the present disclosure.

FIG. 8 depicts a conventional die grinder 170. The die grinder 170 has a hand grip 174, a neck 172 and an on/off switch 178. In addition, the die grinder has a coupler 176 for griping the shaft of the grind rock 180. A die grinder typically rotate at speeds of around 15,000 rpms.

Figure 9:
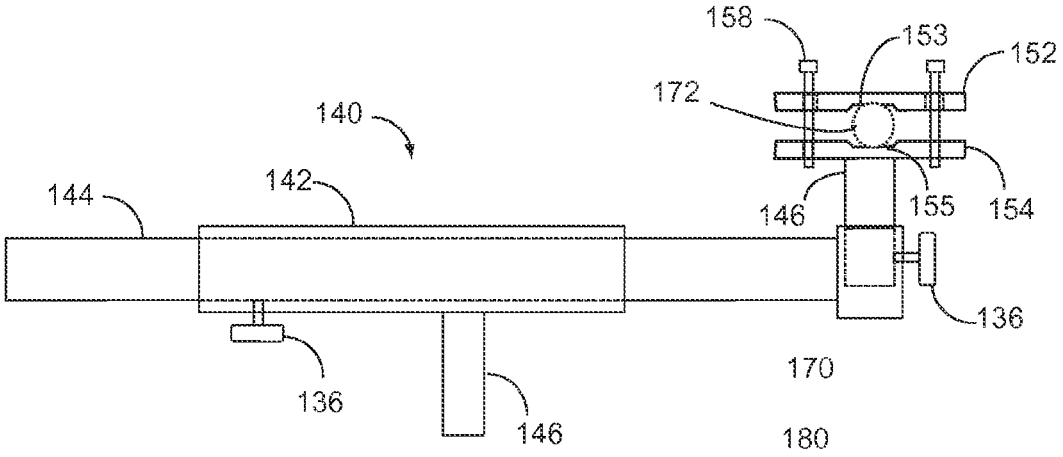
FIG. 9 depicts an embodiment of a die grinder clamp for the reshaping apparatus of FIG. 3.

An embodiment of the clamp 150 of the present disclosure is depicted in FIG. 9. The clamp 150 holds the die grinder 170 in a position for engaging the grind rock 180 with the bandsaw wheel when components of the position frame 102 have been adjusted to place the clamp 150 in a desired position with respect to the bandsaw wheel. The clamp 150 comprises a top plate 152 and a bottom plate 154. Each plate 152, 154 has respective receiving groove 153, 155 that has been shaped to hold the shoulder 172 of the die grinder 170. Securing bolts 158 extend through holes in the top plate 152 into threaded holes in the bottom plate 154. To securely fasten the die grinder 170 into the clamp, an operator places the neck 172 of the die grinder 170 between the plates 152, 154 into the grooves 153, 155 and tightens the securing bolts 158. A rotation bar 146 extends downward from the bottom plate 154 of the clamp. The rotation bar 146 allows the operator to rotate the die grinder 170 to a desired position with respect to the bandsaw wheel 20. To ensure that the die grinder 170 remains in that desired position, the operator tightens lock knob 136.

Figure 10:
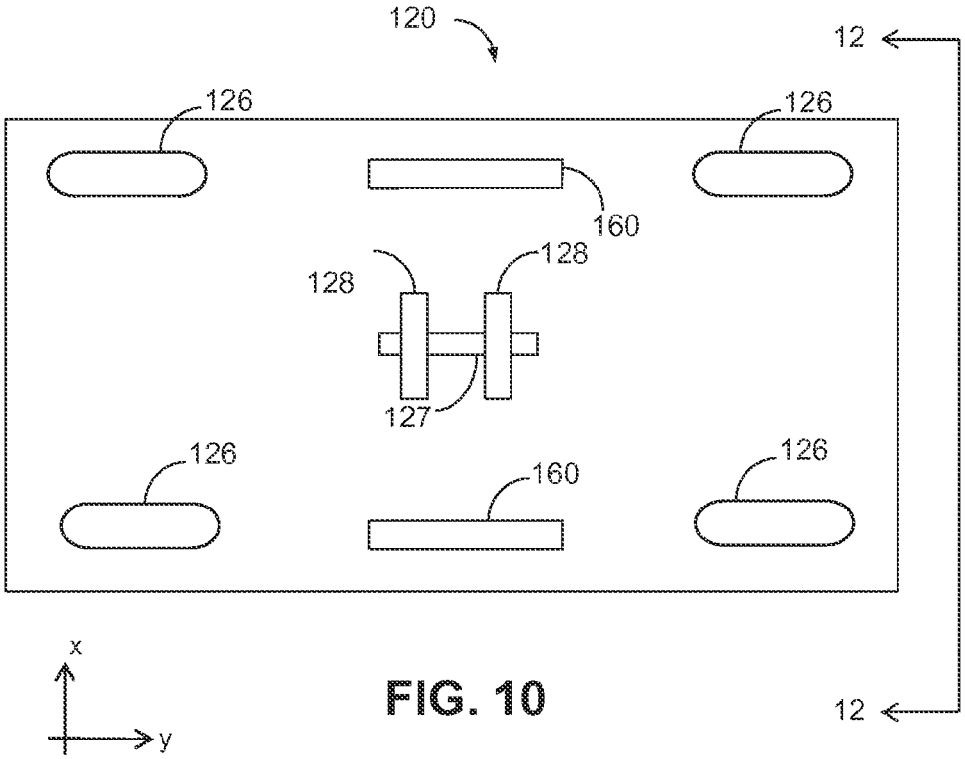
FIG. 10 depicts a top view of a slide plate for the reshaping apparatus of FIG. 3.
Figure 11:
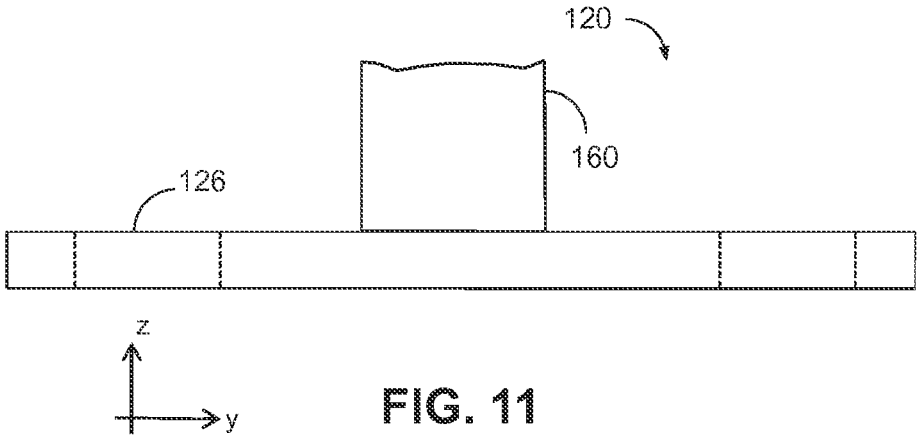
FIG. 11 depicts a side view of the slide plate of FIG. 10.
Figure 12:
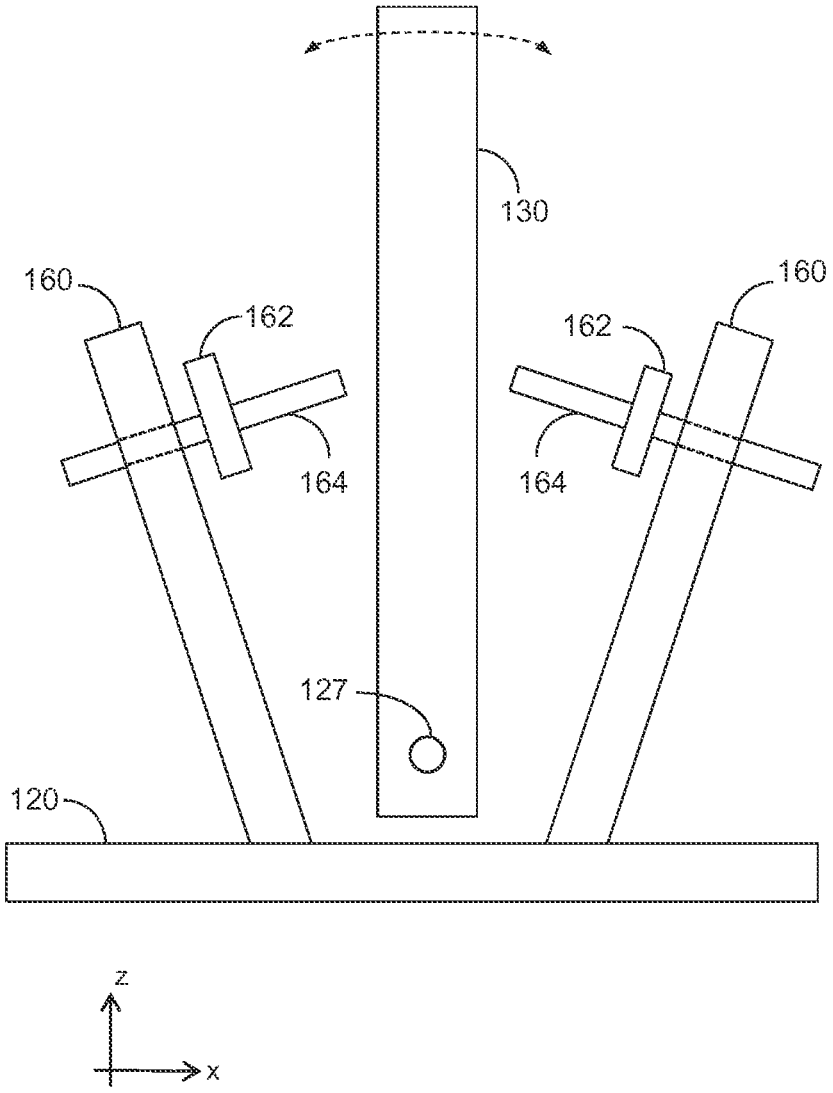
FIG. 12 depicts an end view of the slide plate of FIG. 10 with some components removed to show important features.

FIG. 10 depicts a top view of an embodiment of the slide plate 120. The slide plate has slots 126 for allowing the slide plate to move in the y-direction. Near the center of the slide plate there are two support bars 128 hold pivot pin 127. The pivot pin 127 extends through a hole in the bottom of the vertical arm 130 as best seen in FIG. 12. In addition the slide bar 120 has two angled flanges 160 extend upward (the z-direction). FIG. 12 shows the angled flanges 160 extending at an outward angle from the slide plate 120. Each of the angled flanges 160 has an adjustment rod 162 that goes through a threaded hole in the angled flange 160. A hand wheel 164 is fastened to each of the adjustment rods 162 so that an operator can turn the adjustment rods 162. The adjustment rods 162 may move towards or away from the vertical arm 130 causing it to rotate in either direction depending on the direction that the hand wheels 164 are turned. The adjustment rods 162 can hold the vertical arm 130 at a desired rotational angle as the vertical arm rotates about pivot pin 127. When the die grinder 170 is aligned for reshaping the bandsaw wheel 20 the operator turns the hand wheels 164 in such a way as to nudge the rotating grid rock 180 towards the rotating bandsaw wheel 20.

Figure 13:
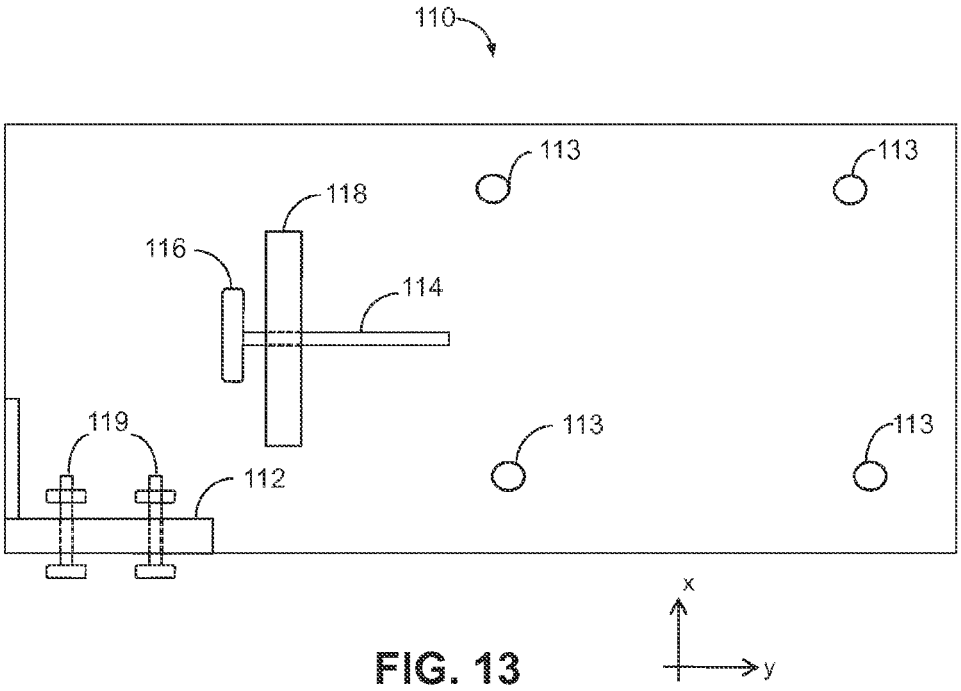
FIG. 13 depicts a top view of a base plate for the reshaping apparatus of FIG. 3.
Figure 14:
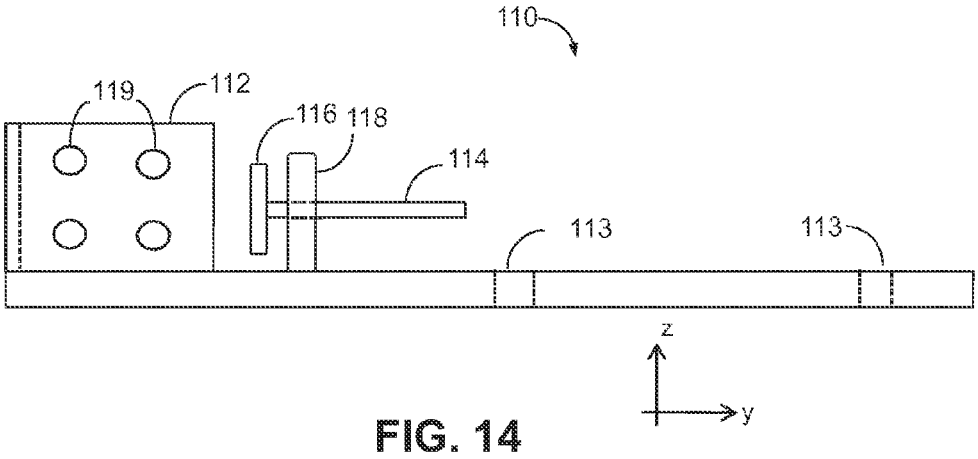
FIG. 14 depicts a side view of the base plate of FIG. 13.

An embodiment of the base plate 110 is depicted in FIG. 13 and FIG. 14. The base plate has threaded holes 113 for receiving the tension bolts 122 that hold springs 124 against the top surface of the base plate 110. The flange 112 of the base plate, as previously seen in FIG. 3, has several blots 119 extending through thread holes in the flange. The bolts 119 are adjusted so that the base plate 110 rests at a desired orientation on frame member 50 of the bandsaw.

Figure 15:
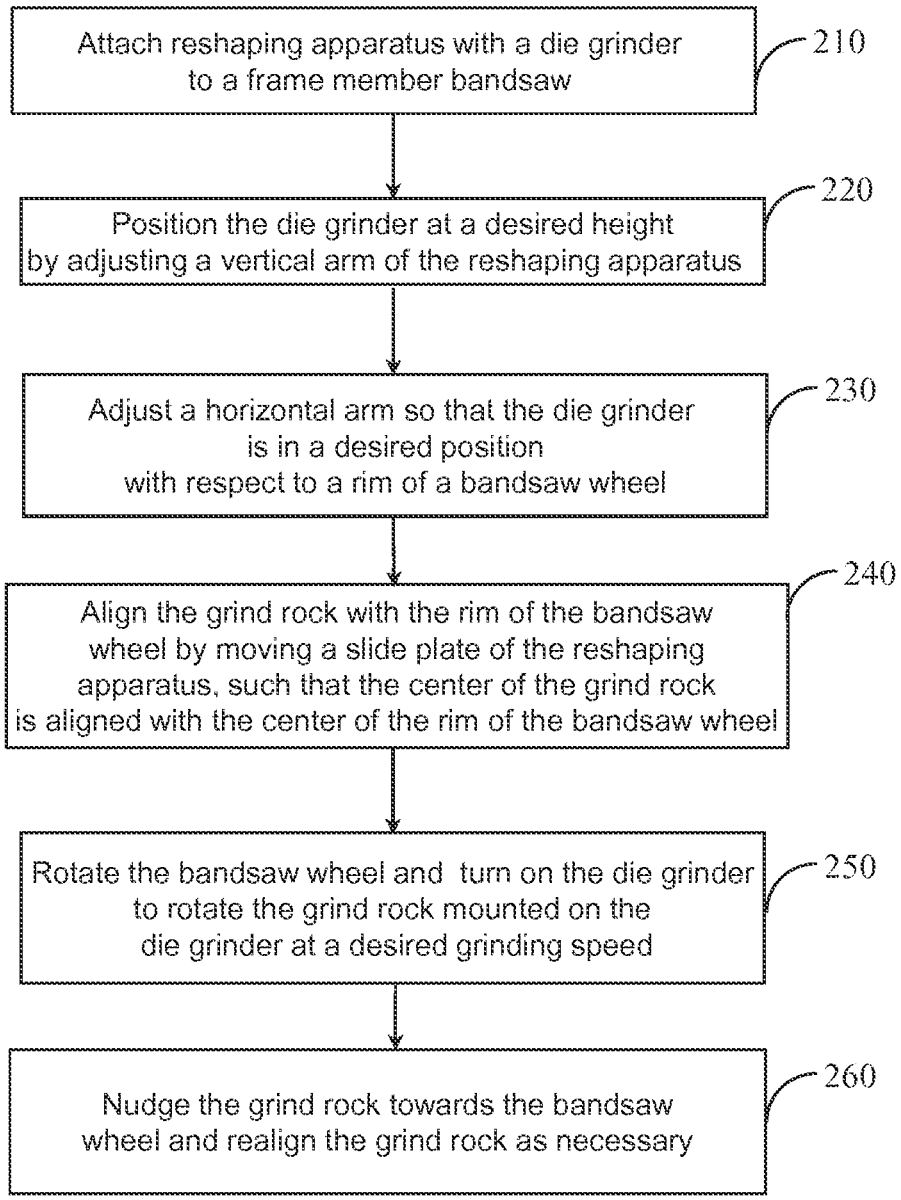
FIG. 15 depicts a method embodiment having steps for reshaping a bandsaw wheel using the reshaping apparatus of FIG. 3.

A method embodiment of the reshaping process is depicted in FIG. 15. The steps, as depicted, describe how an operator installs and uses the reshaping apparatus 100. The operator attaches the base plate 110 to bandsaw frame member 50, block 210. Next the operator adjust of the vertical arm 120 to a desired height, block 220. The horizontal arm 130 is then adjusted to so that the grind rock coupled to a die grinder is in a desired position with respect to a rim of a bandsaw wheel, block 230. The grind rock is aligned with the outside edge of the bandsaw by turning the adjustment knob on the base plate that moves the slide plate. block 240. Next the bandsaw wheel rotates and grind rock rotates, block 250. The grind rock is then nudged towards the bandsaw wheel by turning the hand wheels that rotate the vertical arm, step 260.

In other embodiments, the reshaping apparatus may have a different structure for positioning the grid rock with respect to the outer edge of a bandsaw wheel. However, it would be apparent to a person of ordinary skill upon reading this disclosure that mounting a reshaping apparatus to a frame member, wherein arms or similar components may be used to position a die grinder with a grind rock is an apparatus that falls within the scope of the present disclosure. The disclosure illustrates how a bandsaw operator may reshape a bandsaw wheel without the burden of removing the bandsaw wheel from the bandsaw.

Now, therefore, the following is claimed:

1. A shaping apparatus for shaping an outside edge of a first bandsaw wheel mounted to a bandsaw, the first bandsaw wheel having an axis of rotation, the shaping apparatus comprising:

a die grinder with an axis of rotation for rotating a grind rock, wherein the grind rock has a concave shape;

a base plate attached to the bandsaw, wherein the bandsaw is configured to cut material with a blade looped around the first bandsaw wheel and a second bandsaw wheel mounted to the bandsaw; and a positioning frame attached to the base plate, wherein the positioning frame has one or more arms that align the grind rock with the outside edge of the first bandsaw wheel, wherein the grind rock removes material from the outside edge of the first bandsaw wheel as the die grinder rotates the grind rock and the first bandsaw wheel rotates, and wherein the axis of rotation of the die grinder is parallel to the axis of rotation of the first bandsaw wheel.

2. The shaping apparatus of claim 1, wherein one arm is a vertical arm.

3. The shaping apparatus of claim 2, wherein another arm is a horizontal arm.

4. The shaping apparatus of claim 1, wherein the positioning frame further has a slide plate coupled to the base plate.

5. The shaping apparatus of claim 1, wherein the positioning frame has a clamp for holding the die grinder.

6. The shaping apparatus of claim 2, wherein the vertical arm is coupled to a pivot pin for providing movement of the die grinder towards the bandsaw wheel in response to an operator turning a hand wheel.

7. The shaping apparatus of claim 1, wherein the one or more arms comprises a vertical arm rotationally coupled to a slide plate and a horizontal arm extending from the vertical arm.

8. The shaping apparatus of claim 1, wherein the die grinder rotates at a first speed and the first bandsaw wheel rotates at a second speed.

9. The shaping apparatus of claim 8, wherein the first speed is around 17,000 rpm.

10. The shaping apparatus of claim 1, wherein the concave shape has a peak and lower edges, and wherein the lower edges are approximately ten thousandths of an inch lower than the peak.

11. A system, comprising:

a bandsaw for cutting material with a blade looped about two bandsaw wheels mounted on the bandsaw;

a die grinder with an axis of rotation for rotating a grind rock, wherein the grind rock is shaped to provide a crown shape on an outside edge of one of the mounted bandsaw wheels;

a base plate attached to the bandsaw; and a positioning frame attached to the base plate, wherein the positioning frame has one or more arms that align the grind rock with the outside edge of the one of the mounted bandsaw wheels, wherein the grind rock rotates and removes material from the outside edge as the one of the mounted bandsaw wheels rotates, and wherein the axis of rotation of the of the die grinder is parallel to an axis of rotation of the one of the mounted bandsaw wheels.

* * * * *